US010971865B2

(12) United States Patent
Kojima

(10) Patent No.: US 10,971,865 B2
(45) Date of Patent: Apr. 6, 2021

(54) ELECTRICAL CONNECTOR WITH A MULTI-PART SHIELD

(71) Applicant: Sumitomo Wiring Systems, Ltd., Mie (JP)

(72) Inventor: Yusuke Kojima, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/824,749

(22) Filed: Mar. 20, 2020

(65) Prior Publication Data

US 2020/0303881 A1 Sep. 24, 2020

(30) Foreign Application Priority Data

Mar. 22, 2019 (JP) ..... JP2019-054274

(51) Int. Cl.

| | |
|---|---|
| ***H01R 13/6593*** | (2011.01) |
| *H01R 13/6592* | (2011.01) |
| *H01R 13/648* | (2006.01) |
| *H01R 13/6581* | (2011.01) |
| *H01R 13/6591* | (2011.01) |
| *H01R 9/05* | (2006.01) |

(52) U.S. Cl.

CPC ..... *H01R 13/6593* (2013.01); *H01R 9/0518* (2013.01); *H01R 13/648* (2013.01); *H01R 13/6485* (2013.01); *H01R 13/6581* (2013.01); *H01R 13/6592* (2013.01); *H01R 13/65912* (2020.08); *H01R 13/65915* (2020.08)

(58) Field of Classification Search

CPC ..... H01R 13/6593; H01R 13/6581; H01R 9/0518; H01R 13/6592; H01R 13/65912; H01R 13/648; H01R 13/65915; H01R 13/6485

USPC ..... 439/607.01, 607.41, 607.42, 607.48, 439/607.5, 607.54, 607.55

See application file for complete search history.

(56) References Cited

U.S. PATENT DOCUMENTS

2013/0288523 A1* 10/2013 Ii ..... H01R 13/6581 439/607.01

FOREIGN PATENT DOCUMENTS

JP 2013-229255 11/2013

* cited by examiner

*Primary Examiner* — Abdullah A Riyami
*Assistant Examiner* — Justin M Kratt
(74) *Attorney, Agent, or Firm* — Gerald E. Hespos; Michael J. Porco; Matthew T. Hespos

(57) ABSTRACT

A cable with terminals in the present disclosure includes a shielded cable (80) and an outer conductor (40). The shielded cable (80) includes wires (81) and a shield. The outer conductor (40) includes a tube. The tube collectively covers the outer peripheries of the wires (81) exposed from the shield, and includes a first cover and a second cover. The first cover covers the wires from a first side, and the second cover covers the wires from a second side opposite to the first side with clearances (S) defined between the first and second covers. At least one of the first and second covers includes leakage suppressing portions (58). The leakage suppressing portions (58) extend toward a wire arrangement area (48) where the wires (81) are arranged in the tube.

4 Claims, 7 Drawing Sheets

ELECTRICAL CONNECTOR WITH A MULTI-PART SHIELD

BACKGROUND

Field of the Invention

The disclosure relates to a cable with terminals.

Related Art

Japanese Unexamined Patent Publication No. 2013-229255 discloses a connector to be mounted on an end part of a shielded cable. This connector includes a shield shell and a shield cover for collectively covering the outer peripheries of inner conductors exposed on the end part of the shielded cable. The shield shell includes a bottom plate, two lower side plates extending up from both sides of the bottom plate and a barrel to be crimped to the shielded cable. The shield cover includes a ceiling plate and two upper side plates extending down from both sides of the ceiling plate. The inner conductors are covered by the bottom plate, the lower side plates, the ceiling plate and the upper side plates by assembling the shield cover with the shield shell from above.

In the shield shell of the connector of this type, the size of the barrel changes according to a diameter of the shielded cable. However, if the barrel is enlarged, clearances may be formed between the lower side plates of the shield shell and the upper side plates of the shield cover, and noise generated in the inner conductors leaks through this clearance between the shield shell and the shield cover. Therefore, a countermeasure is required.

This specification discloses a cable with terminals that suppresses leakage of noise to outside is disclosed.

SUMMARY

This disclosure is directed to a cable with terminals including a shielded cable and an outer conductor. The shielded cable includes wires and a shield that covers outer peripheries of the wires. The outer conductor includes a tube and a crimping portion. The crimping portion is crimped to the shield. The tube collectively covers the outer peripheries of the wires exposed from the shield. The tube includes first and second covers. The first cover covers the wires from a first side, and the second cover covers the wires from a second side opposite to the first side with a clearance defined between the first and second covers. At least one of the first and second covers includes a leakage suppressing portion that extends toward a wire arrangement area where the wires are arranged in the tube.

The inventors have focused on a tendency of a high-frequency current to flow more near a conductor surface by a skin effect when flowing in a conductor, and arrange the leakage suppressing portion extending toward the wire arrangement area where the wires are arranged. That is, noise generated in the wires can be concentrated on a surface of the leakage suppressing portion extending toward the wire arrangement area and flow from the tube to the shield of the shielded cable through the leakage suppressing portion. In this way, it is possible to suppress the leakage of the noise generated in the wires to outside through the clearance between the first and second covers.

The first cover may include a first plate and two first side plates. The first plate may be disposed on the first side of the wires, and the two first side plates may extend toward the other side from both side edges of the first plate. The second cover may include a second plate and two second side plates. The second plate may be disposed on the second side of the wires. The two second side plates may extend toward the first side from both side edges of the second plate. The leakage suppressing portion may extend toward the wire arrangement area from at least one of the first side plate and the second side plate.

The leakage suppressing portion extending toward the wire arrangement area is formed on at least one of the first side plate and the second side plate defining the clearance between the first and second covers. That is, noise leaking to outside through the clearance easily can be concentrated on the leakage suppressing portion. In this way, the leakage of the noise to outside through the clearance can be suppressed.

An extending end part of the leakage suppressing portion may be formed into a rectangular shape having a shear surface along a direction intersecting an extending direction of the leakage suppressing portion.

The present inventors further focused on a tendency of a high-frequency current to be concentrated easily on a corner part formed by two surfaces, out of the skin effect. That is, high-frequency noise in the wires easily is concentrated on the extending end part of the leakage suppressing portion and leakage to outside through the clearance between the first and second covering portions can be suppressed.

Further, noise flowing in the tube flows on the surface of the tube by the skin effect. Here, the extending end part of the leakage suppressing portion projects inward of the first and second covers. That is, the noise flowing in the tube also can be concentrated on the leakage suppressing portion, i.e. the extending end part (corner part formed by the two surfaces) of the leakage suppressing portion by the skin effect. In this way, outward radiation of noise flowing in the outer conductor also can be suppressed.

According to this disclosure, it is possible to suppress the leakage of noise to outside.

DETAILED DESCRIPTION

A specific example of the cable with terminals of the present disclosure is described below with reference to the drawings. Note that the present disclosure is not limited to these illustrations and is intended to be represented by claims and include all changes in the scope of claims and in the meaning and scope of equivalents.

One embodiment of the disclosure is described with reference to FIGS. 1 to 5.

[Connector 10]

Figure 1:
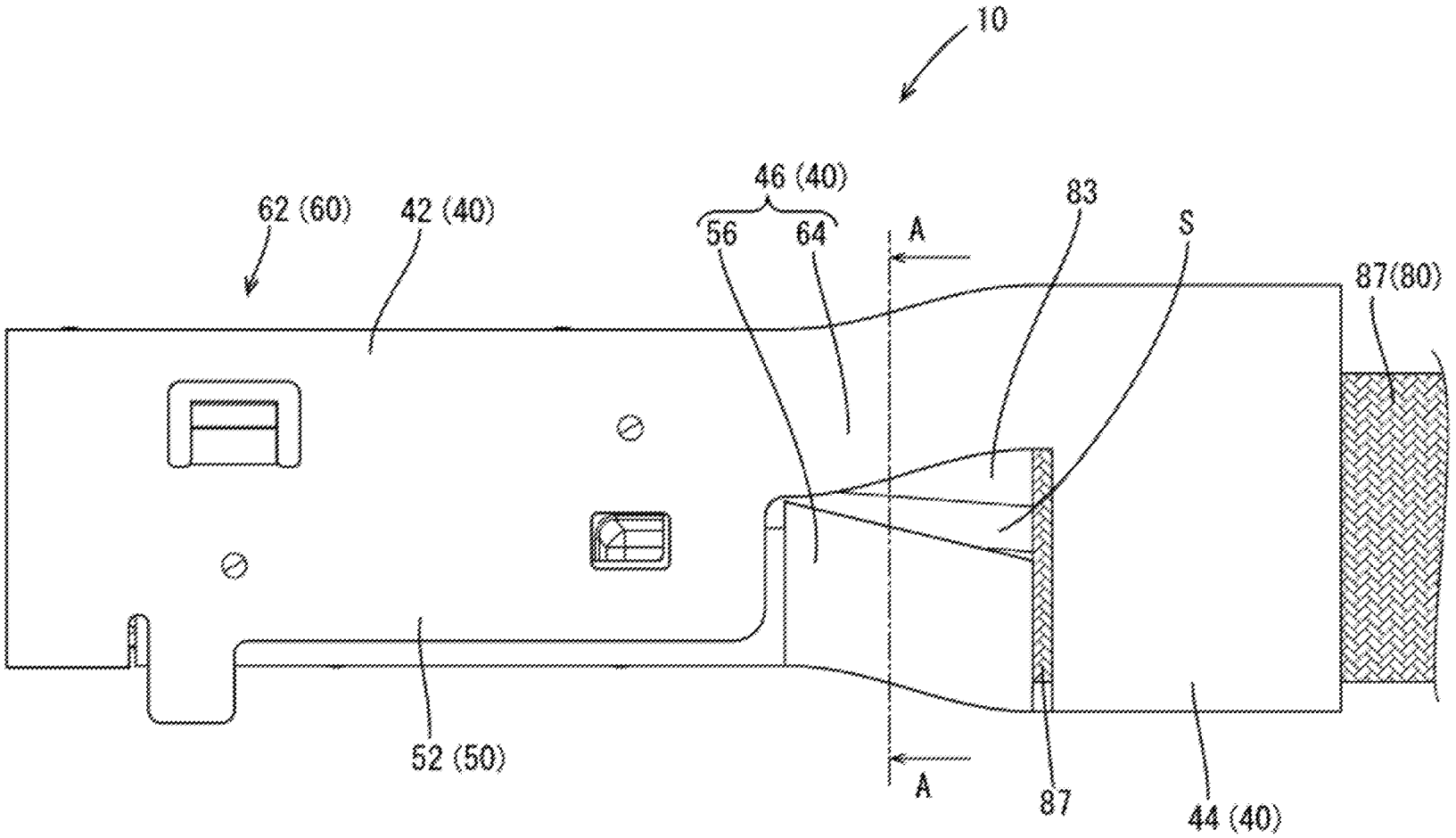
FIG. 1 is a side view of a connector according to an embodiment.
Figure 2:
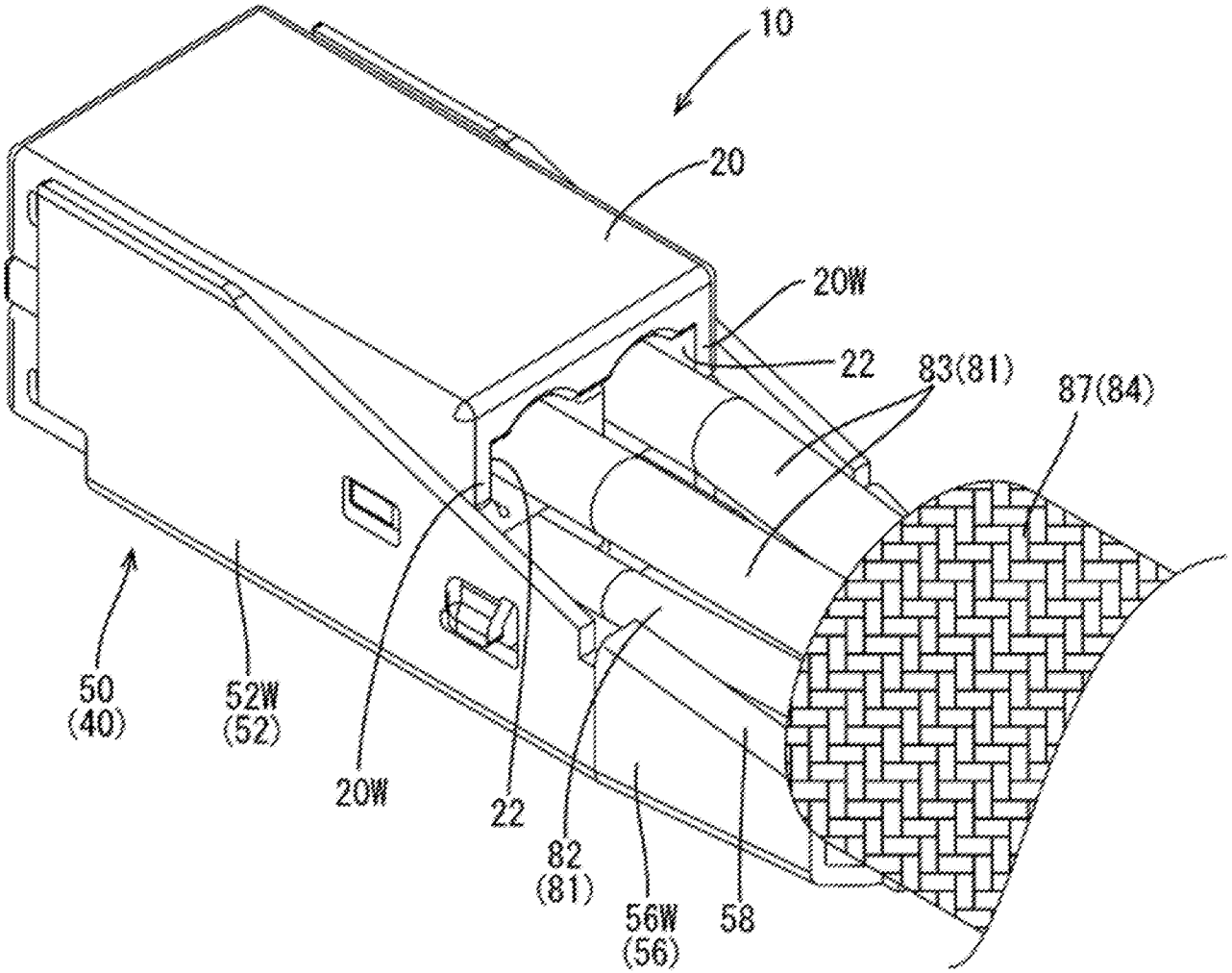
FIG. 2 is a perspective view of the connector in a state where an upper conductor is removed.

A connector 10 of this embodiment is connected to an end part of a shielded cable 80 as shown in FIGS. 1 and 2. The connector 10 includes unillustrated terminals connected to an end of the shielded cable 80, a housing 20 for accommodating the terminals and an outer conductor 40 connected to the end of the shielded cable 80. The shielded cable 80 and the outer conductor 40 are equivalent to a cable with terminals. In the following description, only some of the identical members may be denoted by a reference sign and other identical members may not.

[Shielded Cable 80]

As shown in FIG. 2, the shielded cable 80 includes wires 81, a braided wire (an example of a "shield") 84 covering the outer peripheries of the wires 81 and an outer coating 86 covering the outer periphery of the braided wire 84. The shielded cable 80 of this embodiment includes four wires 81.

The braided wire 84 and the outer coating 86 are stripped on a front part of the shielded cable 80 to expose the wires 81.

The wires 81 include two power supply wires 82 and two signal wires 83 having a larger diameter than the power supply wires 82.

The braided wire 84 exposed by stripping only the outer coating 86 is folded back onto the outer periphery of the outer coating 86 behind the exposed wires 81 to form a shield connecting portion (an example of the "shield") 87.

[Terminals]

The terminals are female terminals and are connected to ends of the wires 81 exposed from the braided wire 84 and the outer coating 86.

[Housing 20]

The housing 20 is formed of insulating synthetic resin and has a rectangular tube shape. Cavities 22 penetrate through the housing 20 in a front-rear direction and are formed side by side in vertical and lateral directions inside the housing 20. In this embodiment, two cavities are formed in each of upper and lower stages, i.e. a total of four cavities are formed side by side in the vertical and lateral directions.

The terminal and an end part of the wire 81 can be accommodated in each cavity 22. The terminals connected to the signal wires 83 are accommodated in the cavities 22 in the upper stage, and the terminals connected to the power supply wires 82 are accommodated in the cavities 22 in the lower stage.

When the terminals and the end parts of the wires 81 are accommodated into the respective cavities 22, the four wires 81 are drawn out rearwardly of the housing 20. Thus, as shown in FIG. 2, the power supply wires 82 and the signal wires 83 are exposed between the housing 20 and the shield connecting portion 87.

[Outer Conductor 40]

Figure 3:
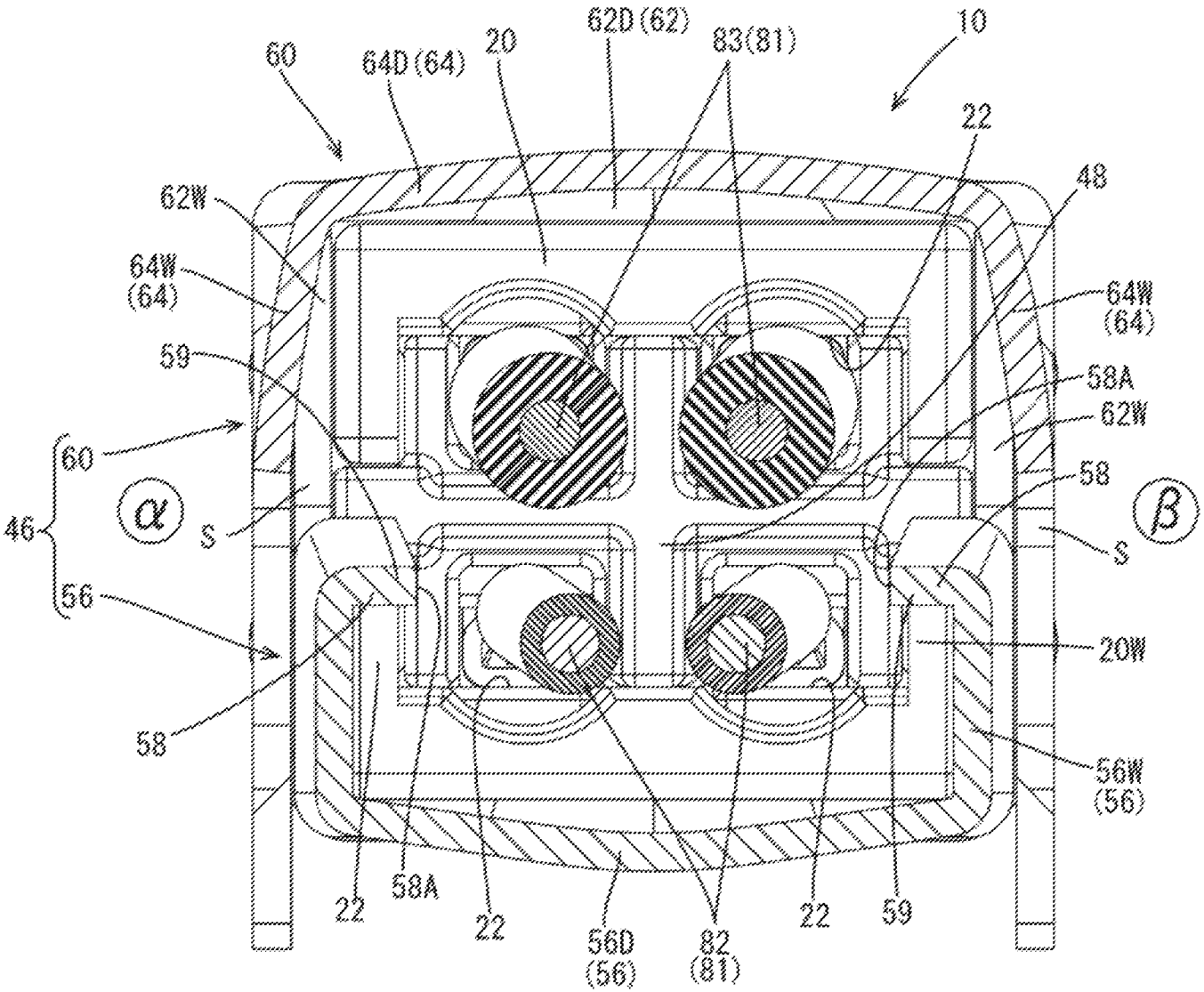
FIG. 3 is a section along A-A of FIG. 1.

The outer conductor 40 is formed by working a conductive metal plate. As shown in FIGS. 1 to 3, the outer conductor 40 includes a rectangular connecting tube 42, a crimping portion 44 to be crimped to the shield connecting portion 87 and a tubular link (an example of a "tube") 46 linking the connecting tube 42 and the crimping portion 44 in the front-rear direction.

[Connecting Tube Portion 42]

The connecting tube 42 accommodates the housing 20 while locking the housing 20 in the front-rear direction.

[Crimping Portion 44]

The crimping portion 44 is a hollow cylinder with a larger diameter than the connecting tube 42. The outer conductor 40 is connected to the braided wire 84 of the shielded cable 80 by crimping the crimping portion 44 to the outer periphery of the shield connecting portion 87.

[Linking Portion 46]

A front part of the link 46 is formed into a rectangular tube shape in accordance with the connecting tube 42, and a rear end part thereof has a hollow cylindrical shape in accordance with the crimping portion 44. The four wires 81 exposed from the braided wire 84 and the outer coating 86 drawn out rearwardly from the housing 20 extend in the front-rear direction in the link 46. A wire arrangement area 48 is defined where the four wires 81 are arranged in the link 46.

Further, the outer coating 40 is formed by vertically assembling a lower conductor 50 and an upper conductor 60 to be assembled with the lower conductor 50 from above.

[Lower Conductor 50]

The lower conductor 50 includes a first half tube 52 constituting a lower part of the connecting tube 42 and a first link (an example of a "first cover") 56 constituting a lower part of the link 46.

Figure 4:
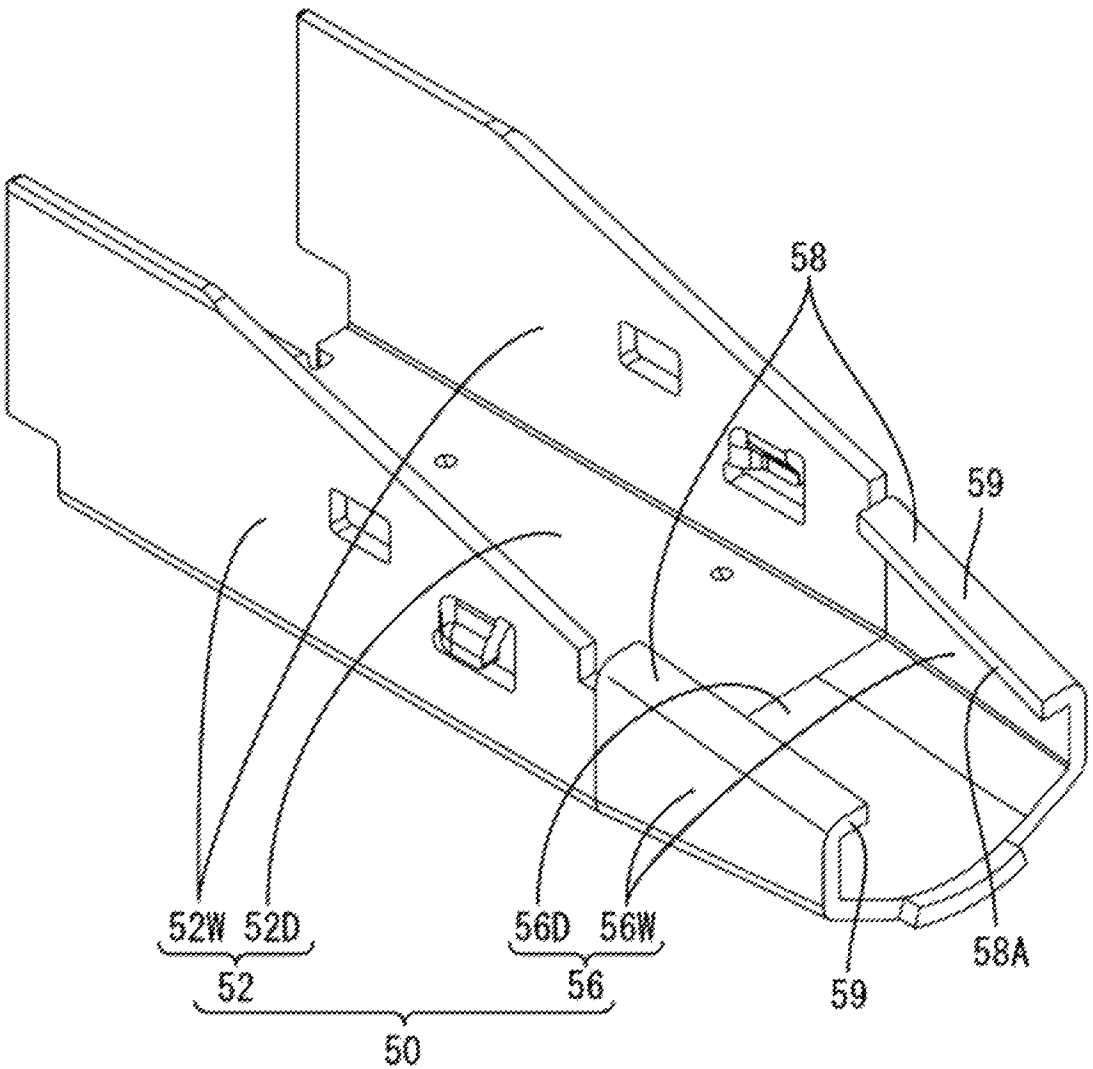
FIG. 4 is a perspective view of a lower conductor.

As shown in FIG. 4, the first half tube 52 is a part of the lower conductor 50 in front of a central part in the front-rear direction. The first half tube 52 includes a first tube plate portion 52D long in the front-rear direction and two first tube side plates 52W extending toward the upper conductor 60 from both lateral sides of the first tube plate 52D.

The first tube plate 52D is a flat rectangular plate long in the front-rear direction. Each of the first tube side plates 52W is a flat plate long in the front-rear direction. An upper rear end behind a central part of the first tube side plate 52W is inclined toward the rear.

The first link 56 becomes narrower in the lateral direction toward the rear behind the first half tube 52 and has a lower end part protruding slightly down.

The first link 56 includes a first linking plate (an example of a "first plate") 56D in the form of a plate connected behind the first tube plate 52D and two first linking side plates (an example of "first side plates") 56W extending toward the upper conductor 60 from both lateral sides of the first linking plate 56D.

The first linking plate 56D is narrowed in the lateral direction toward the rear and having a rounded rear end lower part. Each first linking side plate 56W is a flat plate connected behind the first tube side plate 52W and is long in the front-rear direction. An upper end edge part of the first linking side plate 56W is inclined down toward the rear to be connected to the upper end edge of the first tube side plate 52W.

Figure 5:
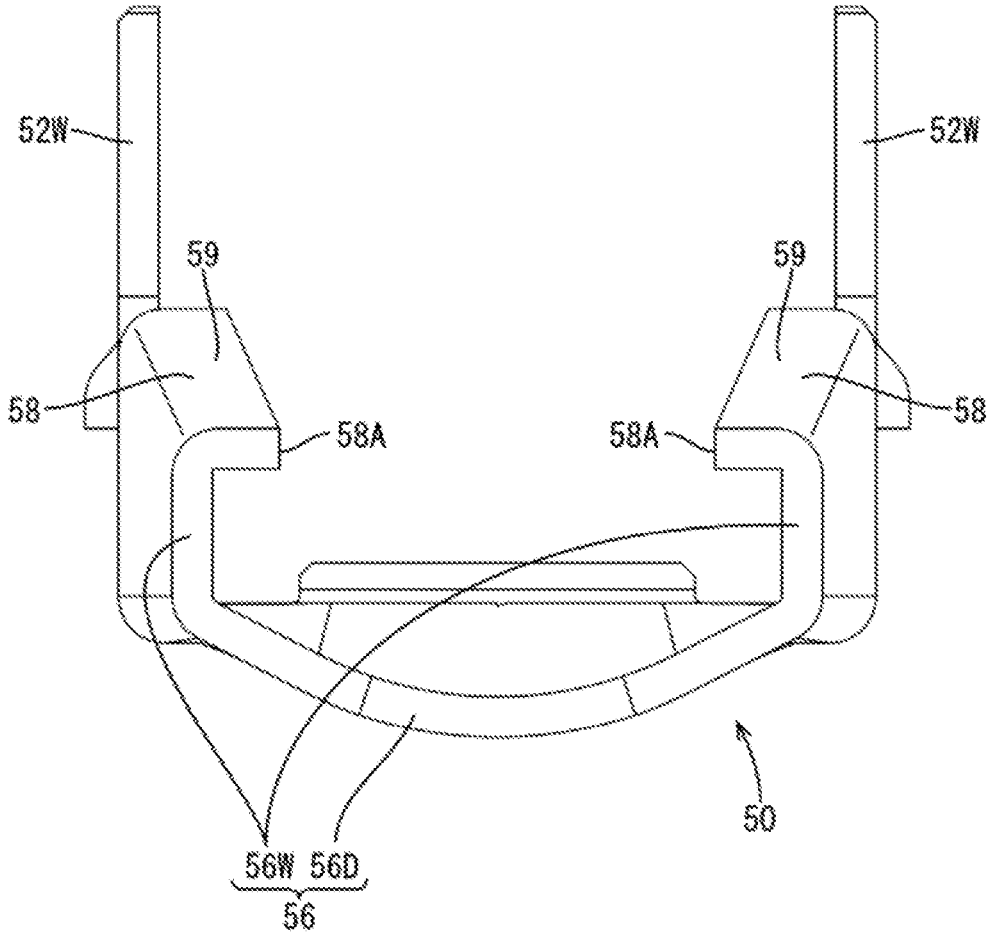
FIG. 5 is a back view of the lower conductor.

As shown in FIGS. 3 to 5, leakage suppressing portions 58 extending in the lateral direction toward each other are formed on the upper end edge parts of the respective first linking side plate portions 56W.

The leakage suppressing portion 58 are flat plates over the entire length of the first linking side plate 56W in the front-rear direction. An extending dimension of the leakage suppressing portion 58 from the first linking side plate 56W is smaller than a thickness of side walls 20W on both left and right sides of the cavity 22 in the housing 20 as shown in FIG. 3.

An extending end edge 59 of the leakage suppressing portion 58 has a rectangular cross-section with a shear surface 58A along the vertical direction intersecting an extending direction of the leakage suppressing portion 58.

[Upper Conductor 60]

As shown in FIG. 1, the upper conductor 60 includes a second half tube 62 constituting an upper part of the connecting tube 42, a second link (an example of a "second cover") 64 constituting an upper part of the link 46, and the crimping portion 44 connected behind the second link 64. The crimping portion 44 is constituted only by the upper conductor 60.

The second half tube 62 is a part of the upper conductor 60 in front of a central part in the front-rear direction. As shown in FIG. 3, the second half tube 62 includes a plate-like second tube plate 62D and two second tube side plates 62W extending toward the lower conductor 50 from both lateral side edges of the second tube plate 62D.

The second tube plate 62D is a flat rectangular plate slightly wider than the first tube plate 52D in the lateral direction and long in the front-rear direction. Each of the second tube side plates 62W is a flat rectangular plate long in the front-rear direction.

The second half tube 62 is assembled with the first half tube 52 to form the rectangular connecting tube 42 with the second tube side plates 62W outside the first tube side plates 52W and with the upper conductor 60 and the lower conductor 50 vertically assembled.

The second linking portion 64 is connected behind the second half tube 62 and is formed such that a rear end part protrudes slightly upward.

As shown in FIG. 3, the second link 64 includes a second linking plate (an example of a "second plate") 64D, which is slightly wider than the first linking plate 56D in the lateral direction, and two second linking side plates (an example of "second side plates") 64W extending toward the lower conductor 50 from lateral side edges of the second linking plate 64D.

The second linking plate 64D has a rounded rear upper part. The second linking side plate 64W is a flat plate having a rounded rear end to be connected to the rear part of the second linking plate 64D.

The second link 64 is assembled to the first linking portion 56 with the second linking side plates 64W outside the first linking side plates 56W and constitutes the tubular link 46 together with the first link 56 with the upper and lower conductors 60 and 50 vertically assembled.

Further, in the link 46, a triangular clearance S is formed between the first linking side plate 56W and the second linking side plate 64W, as shown in FIG. 1. Accordingly, the link 46 has the clearances S at positions on both left and right sides. In this way, the inside and outside of the link 46 communicate through the clearances S.

In other words, the first and second linking portions 56, 64 of the link 46 collectively cover the outer peripheries of the four wires 81 with the clearances S defined between the first and second linking side plates 56W, 64W.

The leakage suppressing portions 58 extending from the second linking side plates 64W are arranged in the wire arrangement area 48 where the four wires 81 are arranged in the link 46.

This embodiment is configured as described above. Next, functions and effects of the connector 10 are described.

For example, in the case of configuring an outer conductor by vertically assembling a lower conductor and an upper conductor as in this embodiment, a clearance may be formed between the lower conductor and the upper conductor if a connecting tube and a crimping portion have different outer peripheral shapes and different outer diameters. If the clearance is formed in the outer conductor, high-frequency noise generated in signal wires disposed inside may leak to outside through the clearance.

Accordingly, the present inventors developed the configuration of this embodiment as a result of an earnest study to solve the above problem. Specifically, this embodiment relates to the connector 10 including the cable with terminals having the shielded cable 80 and the outer conductor 40, the shielded cable 80 includes the wires 81 and the braided wire 84 (shield portion), and the braided wire 84 collectively covers the outer peripheries of the wires 81.

The outer conductor 40 includes the link (tube) 46 and the crimping portion 44. The crimping portion 44 is crimped to the shield connecting portion (shield) 87, and the link 46 collectively covers the outer peripheries of the wires 81 exposed from the braided wire 84. The link 46 includes the first linking portion (first cover) 56 and the second linking portion (second cover) 64. The first linking portion 56 covers the wires 81 from below (first side), and the second linking portion 64 covers the wires 81 from above (second side opposite to the first side) while defining the clearances S between the first and second linking portions 46, 56.

At least one of the first and second linking portions 46, 56 includes the leakage suppressing portions 58, and the leakage suppressing portions 58 extend toward the wire arrangement area 48 where the wires 81 are arranged in the linking portion 46.

The inventors focused on a property of a high-frequency current to flow more near a conductor surface by a skin effect when flowing in a conductor. They then concluded to arrange the leakage suppressing portions 58, to which noise generated from wires flows, toward the wire arrangement area 48.

That is, noise generated in the wires 81 can be concentrated on the surfaces of the leakage suppressing portions 58 arranged in the wire arrangement area 48 and the noise can flow from the link 46 to the braided wire 84 of the shielded cable 80 through the leakage suppressing portions 58. In this way, it is possible to suppress the leakage of the noise generated in the wires 81 to outside through the clearances S between the first and second linking portions 56, 64.

The first linking portion 56 includes the first linking plate 56D and the two first linking side plates 56W, the first linking plate 56D is disposed below the wires 81, and the first linking side plates 56W extend up from the both side edges of the first linking plate 56D.

The second linking portion 64 includes the second linking plate 64D and the two second linking side plates 64W. The second linking plate 64D is disposed above the wires 81, the second linking side plates 64W extend down from the both side edges of the second linking plate 64D, and the leakage suppressing portions 58 extend toward the wire arrangement area 48 from at least either the first linking side plates 56W or the second linking side plates 64W.

At least either the first or second linking side plates 56W, 64W define the clearances S between the first and second linking portions 56, 64 with the leakage suppressing portions 58 extending toward the wire arrangement area 48. That is, noise leaking to outside through the clearances S easily can be concentrated on the leakage suppressing portions 58. In this way, the leakage of noise to outside through the clearances S can be suppressed.

The extending end 59 of the leakage suppressing portion 58 is formed into the rectangular shape having the shear surface 58A along the direction intersecting the extending direction of the leakage suppressing portion 58.

Further, the present inventors focused on a tendency of a high-frequency current to be easily concentrated on a corner part formed by two surfaces, out of the skin effect.

Thus, according to this embodiment, high-frequency noise in the wires 81 easily is concentrated on the extending end edges 59 of the leakage suppressing portions 58 and the leakage of the noise to outside through the clearances S between the first and second linking portions 56, 64 can be suppressed even more.

Further, the noise flowing in the link 46 flows on the surface of the link 46 by the skin effect. Here, the extending end edge parts 59 of the leakage suppressing portions 58 of this embodiment project inward of the link 46.

Thus, noise flowing in the link 46 can be concentrated on the leakage suppressing portions 58, i.e. the extending end edges (corner parts formed by two surfaces) 59 of the leakage suppressing portions 58. In this way, outward radiation of the noise flowing in the link 46 also can be suppressed.

EXAMPLE

Next, a radiation field strength of this example was obtained and confirmed by calculation.

The radiation field strength was confirmed for this example and a comparative example.

Figure 6:
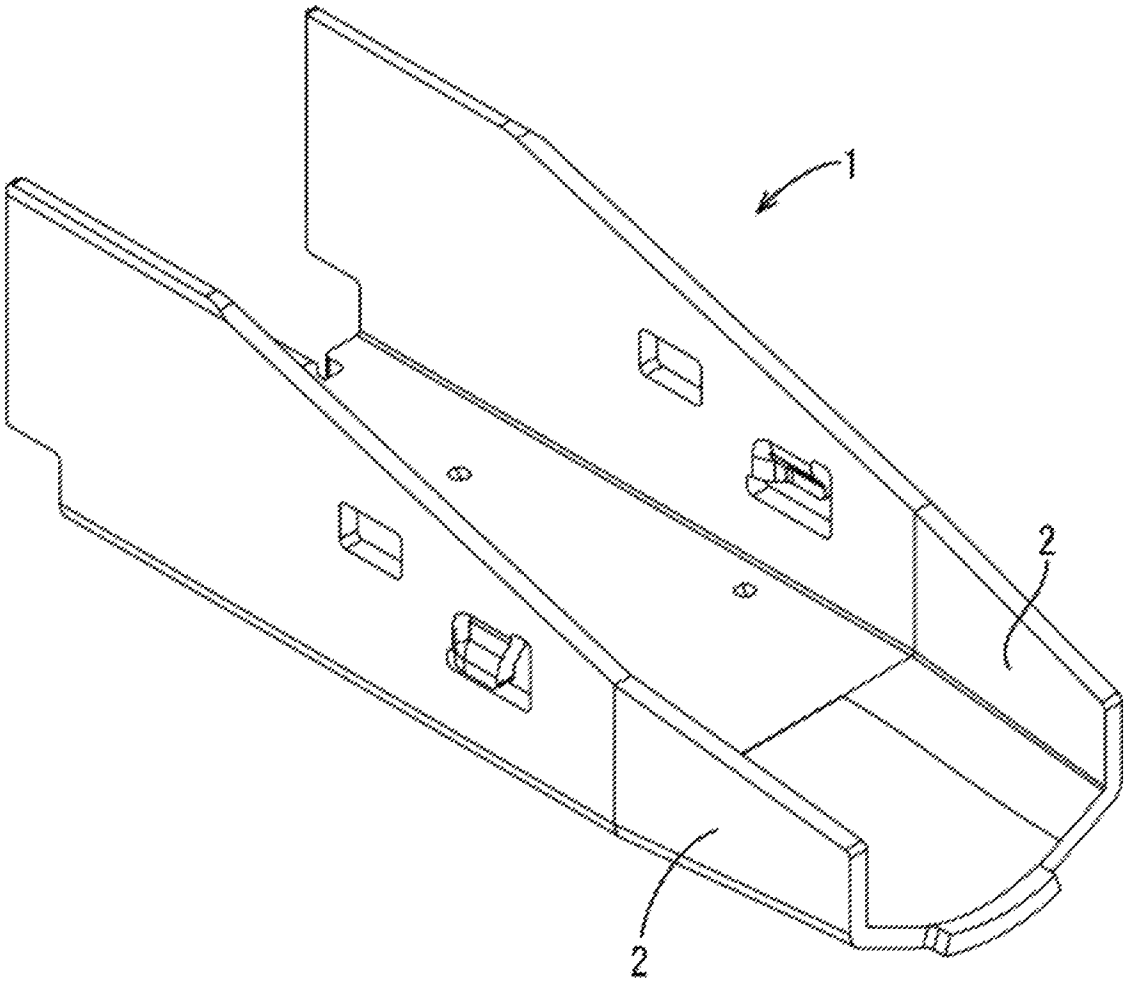
FIG. 6 is a perspective view of a lower conductor according to a comparative example.
Figure 7:
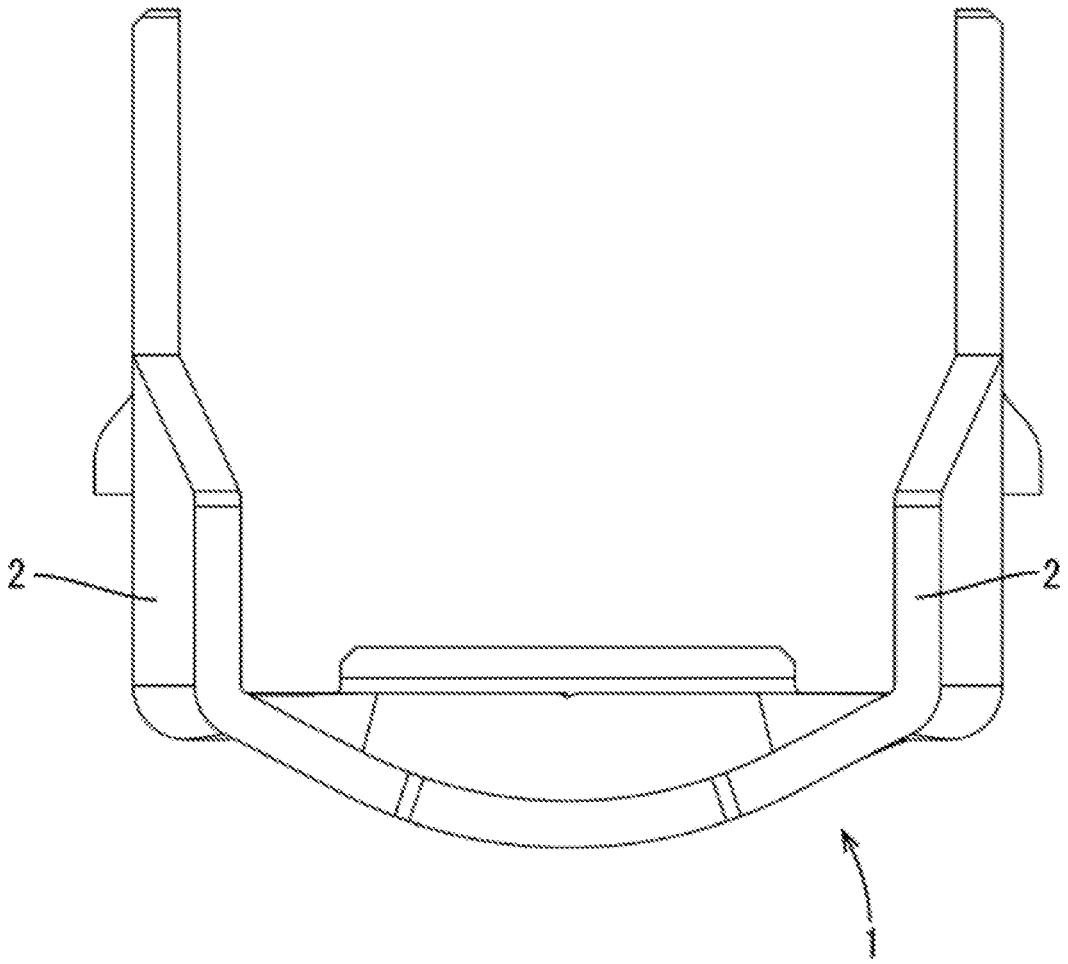
FIG. 7 is a back view of the lower conductor according to the comparative example.

The comparative example uses a lower conductor 1 obtained by removing the leakage suppressing portions 58 from the lower conductor 50, as shown in FIGS. 6 and 7.

That is, the lower conductor 1 of the comparative example is configured such that no leakage suppressing portion is provided on the upper end edges of a pair of linking side plates 2.

The radiation field strength was confirmed for the link 46 when noise was generated from the two signal wires in the upper stage. The radiation field strength was confirmed at confirmation positions α, β on both left and right sides of the link 46 in FIG. 3.

As a result of confirmation, the radiation field strength of this example was lower than that of the comparative example at the both confirmation positions α, β.

Further, it could be confirmed that a decreasing rate of the radiation field strength was higher as compared to the comparative example as noise generated from the signal wires has a higher frequency.

Specifically, high-frequency noise generated from the signal wires is concentrated on the leakage suppressing portions 58, particularly extending end edges 59 of the leakage suppressing portions 58, and flows in the link 46 by the skin effect. In this way, the leakage of the noise to the outside of the outer conductor 40 through the clearances S is suppressed.

<Other Embodiments>

Although the shielded cable 80 includes two signal wires 83 and two power supply wires 82 in the above embodiment, there is no limitation to this. A shielded cable may include only two signal wires or may include a ground wire, a braided wire and the like.

Although the crimping portion 44 on the rear part of the upper conductor 60 in the above embodiment, there is no limitation to this. A crimping portion may be provided on a lower conductor or may be provided on both the lower conductor and an upper conductor.

Although the leakage suppressing portions 58 extend in the lateral direction toward each other from the upper end edges of the first linking side plates 56W in the above embodiment, there is no limitation to this. Leakage suppressing portions may extend obliquely upward or downward from upper end edges of first linking side plates as long as the leakage suppressing portions extend toward a wire arrangement area.

The leakage suppressing portion 58 is formed on the upper end of the first linking side plate 56W in the above embodiment, but may be formed by cutting and raising a middle part of a first linking side plate or may be formed on an upper end edge of a first tube side plate.

Although the leakage suppressing portion 58 is formed on the upper end edge of the first linking side plate 56W in the above embodiment, there is no limitation to this. A leakage suppressing portion may be provided on a lower end edge of a second linking side plate.

Although female terminals are connected to ends of each wire 81, terminals connected to the ends of the wires 81 may be male terminals.

LIST OF REFERENCE SIGNS

10: connector (example of "cable with terminals")
20: housing
20W: side wall
22: cavity
40: outer conductor
42: connecting tube
44: crimping portion
46: linking portion (example of "tube")
48: wire arrangement area
50: lower conductor
52: first half tube
52D: first tube plate
52W: first tube side plate
56: first linking portion (example of "first cover")
56D: first linking plate (example of "first plate")
56W: first linking side plate (example of "first side plate")
58: leakage suppressing portion
58A: shear surface
59: extending end edge part
60: upper conductor
62: second half tube
62D: second tube plate
62W: second tube side plate
64: second link (example of "second cover")
64D: second linking plate (example of "second plate")
64W: second linking side plate (example of "second plate")
80: shielded cable
81: wire
82: power supply wire
83: signal wire
84: braided wire (example of "shield portion")
86: outer coating
87: shield connecting portion (example of "shield")
S: clearance

What is claimed is:

1. A connector, comprising:
a shielded cable; and
an outer conductor,
wherein:
the shielded cable includes wires and a shield,
the shield covers outer peripheries of the wires,
the outer conductor includes a tube and a crimping portion,
the crimping portion is crimped to the shield,
the tube collectively covers outer peripheries of the wires exposed from the shield,
the tube includes a first cover and a second cover,
the first cover covers the wires from a first side,
the second cover covers the wires from a second side opposite to the first side with a clearance defined between the first and second covers,
at least one of the first and second covers includes a leakage suppressing portion, and
the leakage suppressing portion extends toward a wire arrangement area where the wires are arranged in the tube.

2. The connector of claim 1, wherein:

the first cover includes a first plate and two first side plates, the first plate is disposed on the first side of the wires, the two side plates extend toward the second side from opposite side edges of the first plate, the second cover includes a second plate and two second side plates, the second plate is disposed on the second side of the wires, the second side plates extend toward the first side from both side edges of the second plate, and the leakage suppressing portion extends toward the wire arrangement area from at least one of the first side plate and the second side plate.

3. The connector of claim 2, wherein an extending end part of the leakage suppressing portion is formed into a rectangular shape having a shear surface along a direction intersecting an extending direction of the leakage suppressing portion.

4. The connector of claim 1, wherein an extending end part of the leakage suppressing portion is formed into a rectangular shape having a shear surface along a direction intersecting an extending direction of the leakage suppressing portion.

* * * * *